US009470383B2

(12) United States Patent
Kim et al.

(10) Patent No.: US 9,470,383 B2
(45) **Date of Patent: *Oct. 18, 2016**

(54) LED LIGHTING DEVICE INCLUDING MODULE WHICH IS CHANGEABLE ACCORDING TO POWER CONSUMPTION AND HAVING IMPROVED HEAT RADIATION AND WATERPROOF

(71) Applicant: LG Innotek Co., Ltd., Seoul (KR)

(72) Inventors: Kwang Soo Kim, Seoul (KR); Young Ho Shin, Seoul (KR); Ye Seul Yang, Seoul (KR); Ki Man Park, Seoul (KR); Bu Kwan Je, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/324,697

(22) Filed: Jul. 7, 2014

(65) Prior Publication Data

US 2014/0321100 A1 Oct. 30, 2014

Related U.S. Application Data

(63) Continuation of application No. 13/371,121, filed on Feb. 10, 2012, now Pat. No. 8,845,116.

(30) Foreign Application Priority Data

| | | |
|---|---|---|
| Feb. 11, 2011 | (KR) | 10-2011-0012514 |
| Mar. 2, 2011 | (KR) | 10-2011-0018403 |
| Mar. 2, 2011 | (KR) | 10-2011-0018404 |
| Apr. 12, 2011 | (KR) | 10-2011-0033607 |

(51) Int. Cl.
*F21V 9/16* (2006.01)
*F21S 2/00* (2016.01)
(Continued)

(52) U.S. Cl.
CPC ..... *F21S 2/005* (2013.01); *F21K 9/00* (2013.01); *F21K 9/56* (2013.01); *F21S 8/08* (2013.01);
(Continued)

(58) Field of Classification Search
USPC ..... 362/84, 230, 235, 249.02, 294, 373
See application file for complete search history.

(56) References Cited

U.S. PATENT DOCUMENTS

| | | | | |
|---|---|---|---|---|
| 7,771,087 | B2 * | 8/2010 | Wilcox et al. | 362/294 |
| 8,845,116 | B2 * | 9/2014 | Kim | F21K 9/00 362/235 |

FOREIGN PATENT DOCUMENTS

| | | |
|---|---|---|
| CN | 201412734 | 2/2010 |
| CN | 201739903 U | 2/2011 |

(Continued)

OTHER PUBLICATIONS

European Search Report for 12154839 dated May 14, 2012.
(Continued)

*Primary Examiner* — Andrew Coughlin
*Assistant Examiner* — Meghan Ulanday
(74) *Attorney, Agent, or Firm* — Birch, Stewart, Kolasch & Birch, LLP

(57) ABSTRACT

Disclosed is an LED lighting device of which the number of LED modules thereof is changeable according to power consumption. Through a structural change of the module, heat radiation and waterproof can be greatly improved and the size, weight and manufacturing cost can be reduced. Also, a fastening bolt allows the module to be simply attached and separated and maintenance, repair and stability can be improved by providing a wiring space inside the device. Further, there is an advantage of additionally adding a light detection sensor through a cover. The LED lighting device according to the embodiment includes a plurality of heat radiating plates; at least one light source module disposed on one surface of the heat radiating plate.

18 Claims, 9 Drawing Sheets

(51) Int. Cl.

| | |
|---|---|
| ***F21V 29/503*** | (2015.01) |
| ***F21K 99/00*** | (2016.01) |
| ***F21S 8/08*** | (2006.01) |
| ***F21V 29/00*** | (2015.01) |
| ***F21V 31/00*** | (2006.01) |
| ***F21V 29/71*** | (2015.01) |
| ***F21V 29/76*** | (2015.01) |
| ***F21V 29/77*** | (2015.01) |
| *F21W 131/103* | (2006.01) |
| *F21Y 113/00* | (2016.01) |

(52) U.S. Cl.
CPC ..... *F21V 29/004* (2013.01); *F21V 29/2212* (2013.01); *F21V 29/503* (2015.01); *F21V 29/71* (2015.01); *F21V 29/763* (2015.01); *F21V 29/773* (2015.01); *F21V 31/005* (2013.01); *F21W 2131/103* (2013.01); *F21Y 2113/00* (2013.01)

(56) References Cited

FOREIGN PATENT DOCUMENTS

| | | |
|---|---|---|
| EP | 1906081 | 4/2008 |
| KR | 1020090124643 | 12/2009 |

OTHER PUBLICATIONS

Chinese Office Action for application No. 201210030689.4 dated May 4, 2015.

* cited by examiner

LED LIGHTING DEVICE INCLUDING MODULE WHICH IS CHANGEABLE ACCORDING TO POWER CONSUMPTION AND HAVING IMPROVED HEAT RADIATION AND WATERPROOF

CROSS-REFERENCE TO RELATED APPLICATIONS

This application is a Continuation Application of U.S. application Ser. No. 13/371,121 filed Feb. 10, 2012, which claims priority from Korean Application Nos. 10-2011-0012514 filed on Feb. 11, 2011, 10-2011-0018403 filed on Mar. 2, 2011, 10-2011-0018404 filed on Mar. 2, 2011, and 10-2011-0033607 filed on Apr. 12, 2011, the subject matters of which are incorporated herein by reference.

BACKGROUND

1. Field

Embodiments may relate to a light emitting diode (LED) lighting device.

2. Background

In general, a light emitting diode (LED) is a semiconductor light emitting device which emits light when electric current flows. The LED includes a PN junction diode composed of a photo-semiconductive material such as GaAs, GaN. The area of light emitted from the LED ranges from a red area (630 nm to 700 nm) to a blue-violet area (400 nm) and includes blue, green and white areas as well.

The LED has a lower power consumption, high efficiency, a long operating life span and the like as compared with a conventional lighting such as an incandescent electric lamp and a fluorescent lamp. Therefore, demands for the LED are now continuously increasing. Recently, the LED is now being applied to a wider range including an outdoor lighting device, for example, a small-sized lighting of a mobile terminal, a vehicle lighting, an indoor lighting, an outdoor signboard and a street lamp.

When it comes to a prior LED street lamp, an LED module has been designed and manufactured according to power consumption. Therefore, there has been a disadvantage in that the LED module should be differently manufactured according to various power consumptions.

The prior LED street lamp has a large size, heavy weight and a high price. For example, the prior LED street lamp has a size of 1250×300×93 and its weight of 17 kg.

Also, the prior LED street lamp has a poor heat radiating characteristic and a poor waterproof effect. For example, the prior LED street lamp has been measured to have a thermal conductivity of about 2.5° C./W.

SUMMARY

Provided is an LED lighting device of which the number of LED modules thereof is changeable according to power consumption.

Provided is the LED lighting device of which the size, weight and manufacturing cost are reducible.

Provided is the LED lighting device having improved heat radiation.

Provided is the LED lighting device having improved waterproof.

Provided is the LED lighting device having waterproof improved by introducing a fluid or air.

Provided is the LED lighting device including the module which is simply attached and separated by a fastening bolt.

Provided is the LED lighting device having improved maintenance, repair and stability by providing a wiring space within the device.

Provided is the LED lighting device providing a cover in which a light detection sensor is disposed.

One embodiment is a lighting device. The lighting device may include: a plurality of heat radiating plates; at least one light source module disposed on one surface of the heat radiating plate; a cover disposed on the other surface of the heat radiating plate; two side frames, each of which is disposed on a right side and a left side of the heat radiating plate respectively; a cap disposed on a top side of the heat radiating plate, and coupled to one end of the side frame; and a support frame disposed on a bottom side of the heat radiating plate, and coupled to the other end of the side frame.

In the LED lighting device, the plurality of heat radiating plates may be arranged in contact with each other in a longitudinal direction of the side frame.

In the LED lighting device, the light source module may comprise at least one light emitting device.

In the LED lighting device, the cover may include a plurality of holes penetrating through both sides thereof.

In the LED lighting device, the lathing emitting device may include at least one of a colored LED chip, a white LED chip or an UV chip.

The light source module may include: a clad metal layer; an insulating structure which is disposed on the clad metal layer; a light emitting module which is disposed on the insulating structure and includes a plurality of light emitting device; a lens structure which is disposed on the light emitting module; a packing structure which is disposed on the lens structure; and a case which is disposed on the packing structure and is coupled to the clad metal layer.

The case may include a first opening portion through which light which has passed through the lens structure is emitted. The case may include a plurality of heat radiating fins disposed on the outer surface thereof.

The lens structure may be disposed to have a dome shape over the light emitting device and may include at least one of a yellow fluorescent material, a green fluorescent material or a red fluorescent material.

The LED lighting device may further include a heat radiating plate is disposed under the light emitting module. The heat radiating plate comprises one of a thermal conduction silicon pad or a thermal conductive tape.

The heat radiating plate may include: a plate-shaped base; a plurality of heat radiating fins extending upwardly from the base; and a least one of hole disposed between the plurality of heat radiating fins.

In the heat radiating plate, one side of the base may be inclined in a longitudinal direction of the heat radiating fin. One or a plurality of the light source modules may be disposed on a side opposite with the side on which the heat radiating fin is disposed. The heat radiating plate may be disposed of at least any one selected from the group consisting of Cu, Ag, Au, Ni, Al, Cr, Ru, Re, Pb, Cr, Sn, In, Zn, Pt, Mo, Ti, Ta, W and Mg, or is disposed of an alloy including the metallic materials.

The side frame may include: a lower member; an upper member spaced apart from the lower member; at least one connecting member which connects the lower member with the upper member; and a second opening portion partitioned by the upper member, the lower member and the connecting member.

A portion of the top surface of the lower member may be inclined perpendicular to the longitudinal direction of the lower member with respect to the bottom surface of the lower member. A plurality of grooves may be disposed in the top surface of the lower member perpendicularly to the longitudinal direction of the lower member.

The LED lighting device may include at least one duct which is adjacent to the heat radiating plate and is disposed on the lower member of the side frame in the longitudinal direction of the side frame. Here, the duct may include a base and an extension part extending upwardly from both ends of the base and including a hole at one end of the extension part.

The support frame may include: a lower support frame which is coupled to the upper support frame, includes an inner space in which the power controller is disposed and includes a third opening portion corresponding to the inner space; a flange which is fastened and coupled to the opening of the lower support frame; and a packing which is disposed between the upper support frame and the lower support frame.

The LED lighting device may include a heat radiation sheet or a thermal pad between the light source module and the heat radiating plate.

The LED lighting device may further include a power controller which is disposed inside the support frame and controls the supplying of electric power to the light source module.

The lighting device using the light emitting device according to the embodiment can be configured by controlling the number of the LED modules according to power consumption, so that the lighting device can be used to implement various products.

As compared with a conventional LED lighting device, the lighting device according to the embodiment has reduced size, weight and manufacturing cost.

The lighting device according to the embodiment is able to greatly improve heat radiation by obtaining high efficiency heat radiation and high efficiency thermal conductivity through restructuring.

In the lighting device according to the embodiment, it is possible to greatly improve waterproof by applying a waterproof connector and by introducing a fluid or air.

In the lighting device according to the embodiment, it is possible to simply attach and remove the module by means of a fastening bolt.

In the lighting device according to the embodiment, it is possible to improve maintenance, repair and stability by providing a wiring space within the device.

The lighting device according to the embodiment can be applied to various products by providing a cover in which a light detection sensor is disposed.

BRIEF DESCRIPTION OF THE DRAWINGS

Arrangements and embodiments may be described in detail with reference to the following drawings in which like reference numerals refer to like elements and wherein.

DETAILED DESCRIPTION

A thickness or size of each layer is magnified, omitted or schematically shown for the purpose of convenience and clearness of description. The size of each component does not necessarily mean its actual size.

It will be understood that when an element is referred to as being 'on' or "under" another element, it can be directly on/under the element, and one or more intervening elements may also be present. When an element is referred to as being 'on' or 'under', 'under the element' as well as 'on the element' can be included based on the element.

Hereafter, detailed technical characteristics to be embodied will be described in detail with reference to the accompanying drawings.

Figure 1:
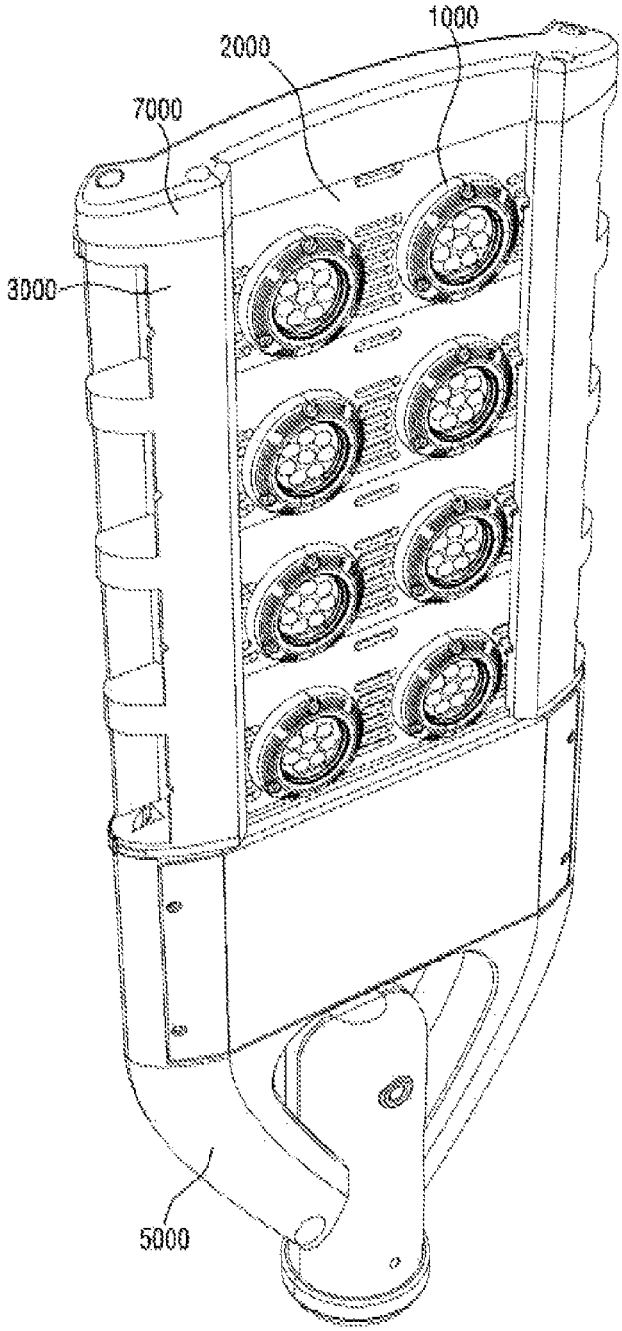
FIG. 1 is a perspective view of a lighting device according to an embodiment.
Figure 2:
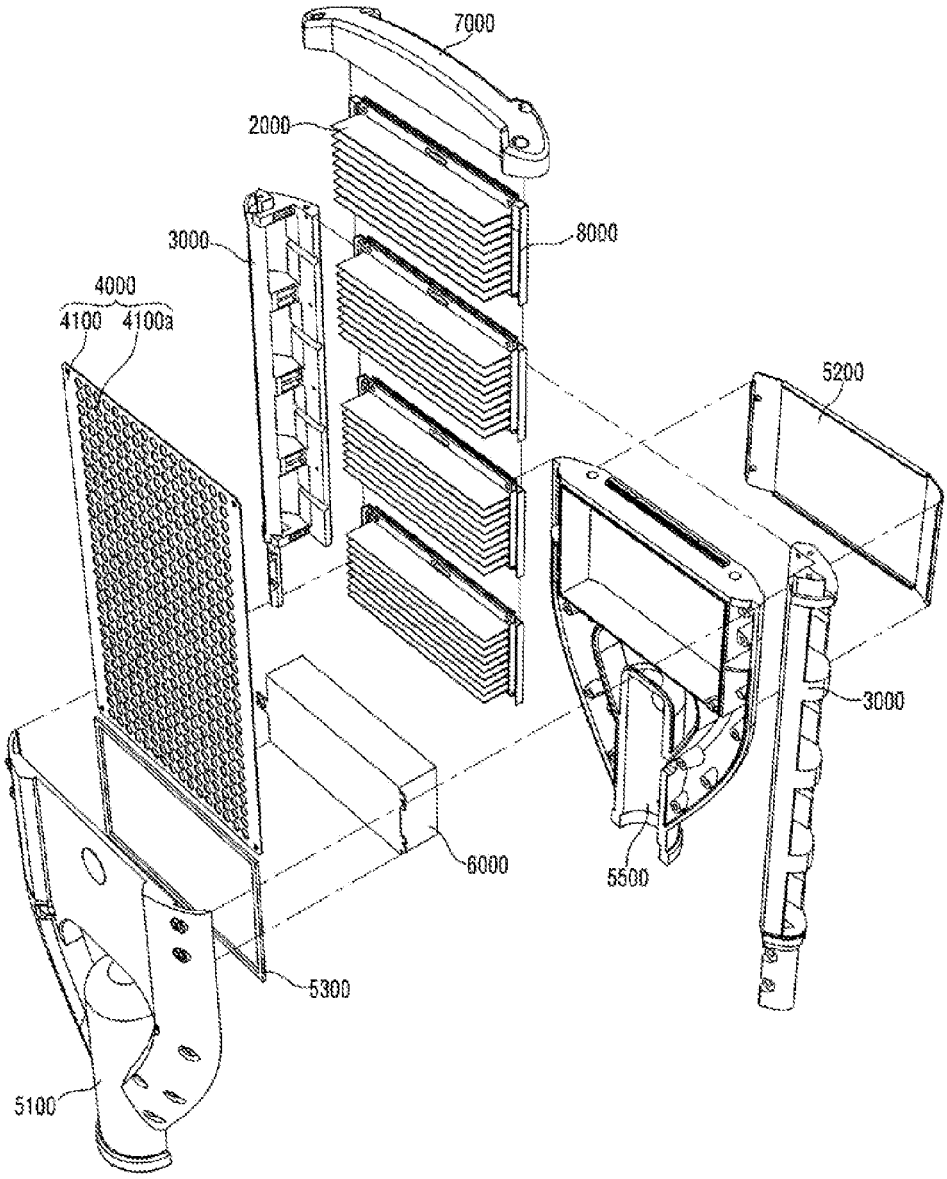
FIG. 2 is an exploded perspective view of the lighting device.

FIG. 1 is a perspective view of a lighting device according to an embodiment. FIG. 2 is an exploded perspective view of the lighting device.

The lighting device according to the embodiment includes, as shown in FIGS. 1 and 2, a light source module 1000, a heat radiating plate 2000, a side frame 3000, a cover 4000, a support frame 5000, a power controller 6000, a cap 7000 and a duct 8000.

The lighting device includes the light source module 1000 including a plurality of light emitting device and includes the heat radiating plate 2000 for radiating heat generated from the light emitting device. Here, the light emitting device may include a colored LED chip, a white LED chip or an UV chip.

The number of the light source modules 1000 which are included in the lighting device is controlled according to the power consumption of the lighting device. According to the embodiment shown in the drawings, it is shown that two light source modules 1000 are disposed in one heat radiating plate 2000, and four heat radiating plates 2000 are provided to the lighting device.

The light source module 1000 is disposed on the front of the heat radiating plate 2000. The cover 4000 is disposed on the rear of the heat radiating plate 2000. The side frame 3000 supporting the heat radiating plate 2000 is disposed on the right and left of the heat radiating plate 2000.

The one side of the side frame 3000 is coupled to the support frame 5000. The other side of the side frame 3000 is coupled to the cap 7000. The power controller 6000 is disposed inside the support frame 5000 and supplies electric power to the light source module 1000. The duct 8000, i.e., a power supply path for supplying power is disposed between the heat radiating plate 2000 and the side frame 3000.

The heat radiating plate 2000 are, as shown in FIG. 2, separately disposed. A plurality of the light source modules 1000 may be disposed on one side of the heat radiating plate 2000 at an equal interval. As shown in FIGS. 1 and 2, a plurality of the heat radiating plate 2000 are coupled to each other according to the power consumption of the lighting device and may be arranged in a direction of side of the support frame 5000. That is, one sides of the plurality of the heat radiating plate 2000 arranged to be in contact with each other are on the same plane. As a result, the plurality of the light source modules 1000 disposed on one side of each heat radiating plate 2000 are actually disposed at an equal interval on the same plane.

Subsequently, based on FIGS. 1 and 2, the cap 7000 is disposed on the heat radiating plate 2000. The support frame 5000 is disposed under the heat radiating plate 2000. The side frame 3000 is disposed on both sides of the heat radiating plate 2000. When the lighting device is installed, the cover 4000 is disposed on the heat radiating plate 2000 and the light source module 1000 is disposed under the heat radiating plate 2000.

Here, the cover 4000 is comprised of a body 4100 having a thin plate shape. The body 4100 includes a plurality of through-holes 4100*a* disposed therein. The cover 4000 functions to prevent external impurities from penetrating into the heat radiating plate 2000. The through-hole 4100*a* allows the heat radiating plate 2000 to contact with the outside air and improves the heat radiating characteristic through air convection.

In case of rain, the lighting device according to the embodiment is configured to allow rainwater to pass through the through-hole 4100*a* of the cover 4000 and through holes (see reference numeral 2100*a* of FIG. 6) of the heat radiating plate 2000 and to be freely discharged to the outside. Therefore, waterproof characteristics can be improved.

The size of the diameter of the through-hole 4100*a* of the cover 4000 may be disposed to be substantially the same as that of the diameter of the through-hole 2100*a* of the heat radiating plate 2000. However, it is recommended that the size of the diameter of the through-hole 4100*a* of the cover 4000 should be smaller than that of the diameter of the through-hole 2100*a* of the heat radiating plate 2000. This intends to prevent external impurities from penetrating through the through-hole 4100*a* of the cover 4000.

In the disposition of the cover 4000 on the heat radiating plate 2000, one side of the cover 4000 may be disposed in contact with heat radiating fins (see reference numeral 2300 of FIG. 5) of the heat radiating plate 2000 in consideration of a heat radiating characteristic by conductivity. Further, the one side of the cover 4000 may be disposed apart from the heat radiating fins 2300 of the heat radiating plate 2000 at a regular interval in consideration of a heat radiating characteristic by convection with outside air.

The material of the cover 4000 may be the same as that of the heat radiating plate 2000 or may be a metallic material or a plastic material in order to reduce the weight of the cover 4000.

The total size of the lighting device can be reduced by arranging structures such as the support frame 5000, the heat radiating plate 2000 and the cap 7000 in the longitudinal direction of the lighting device. Also, since the heat radiating plate 2000, the light source module 1000, the side frame 3000, the duct 8000 and the like are attachable and removable, they may be added or removed depending on the length of the lighting device.

Figure 3:
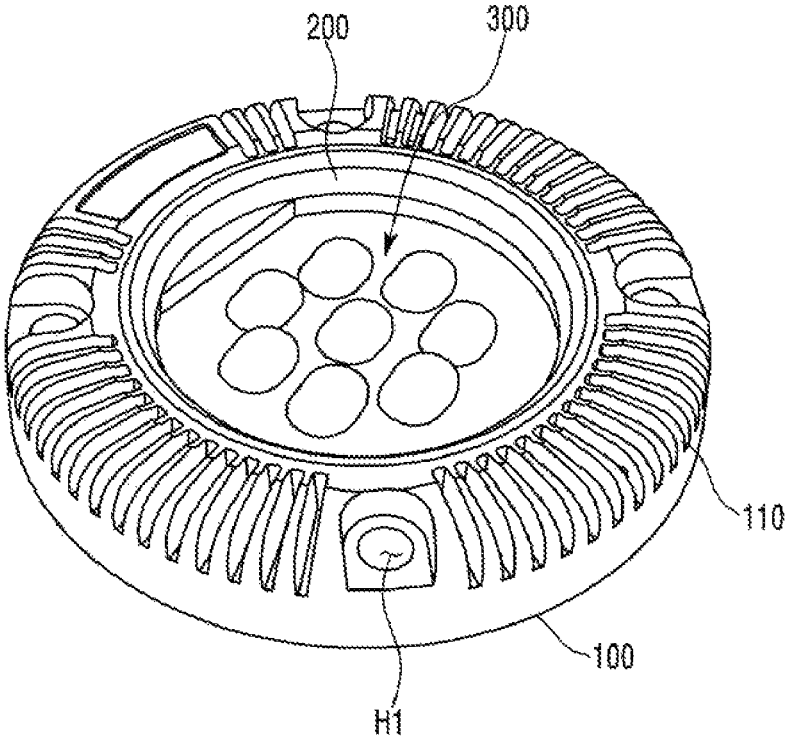
FIG. 3 is a perspective view of a light source module according to the embodiment.
Figure 4:
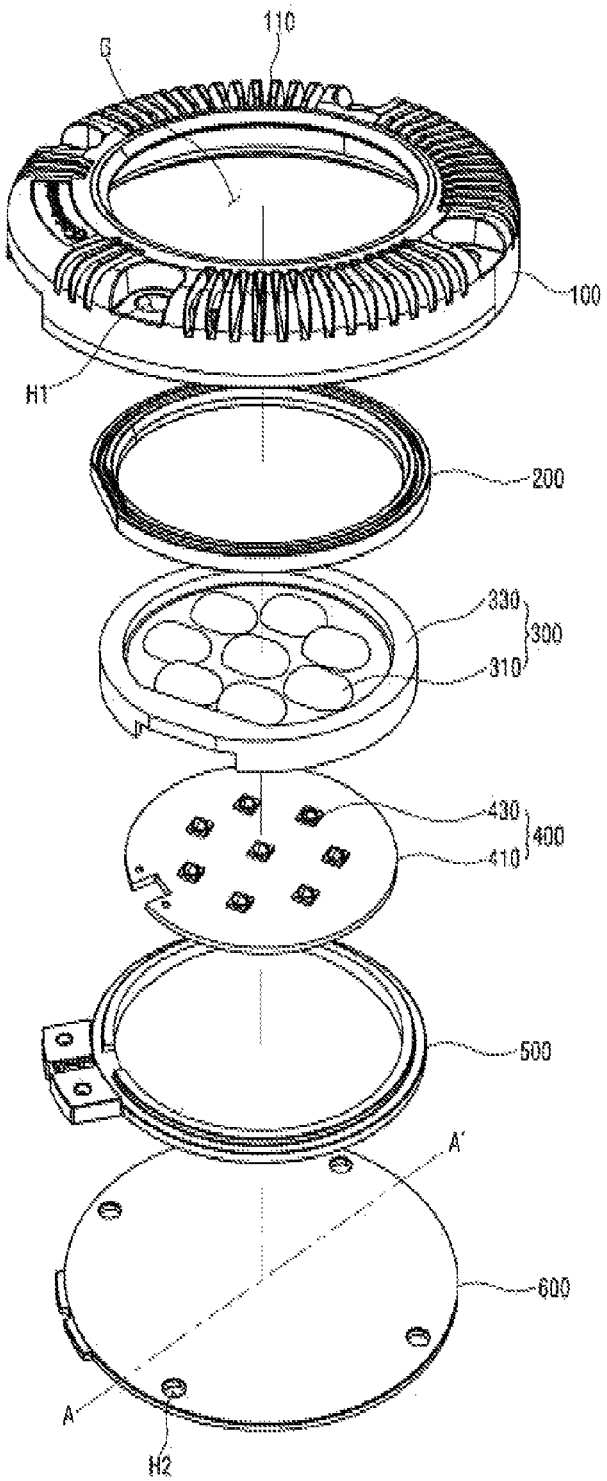
FIG. 4 is an exploded perspective view of the light source module.

FIG. 3 is a perspective view of a light source module according to the embodiment. FIG. 4 is an exploded perspective view of the light source module.

As shown in FIGS. 3 and 4, the light source module 1000 may include a case 100, a packing structure 200, a lens structure 300, a light emitting module 400 and an insulating structure 500. The light source module 1000 may further include a clad metal layer 600.

The case 100 forms a body of the light source module 1000 by being coupled and fixed to the clad metal layer 600 by means of a coupling means like a coupling screw (not shown), etc. Specifically, when the coupling screw passes through a through-hole "H1" of the case 100 and is inserted into a coupling hole "H2" of the clad metal layer 600, the case 100 and the clad metal layer 600 may be coupled and fixed to each other.

The case 100 may be coupled to or separated from the clad metal layer 600 by use of the coupling screw. Therefore, when the light source module 1000 is broken, the light source module 1000 can be maintained and repaired by inserting or removing the coupling screw. Although the embodiment shows the case 100 has a circular shape, the case 100 may have various shapes including the circular shape.

The light source module 1000 receives and protects the packing structure 200, the lens structure 300, the light emitting module 400 and the insulating structure 500, all of which are located between the case 100 and the clad metal layer 600.

The case 100 includes a first opening portion (G) through which light which has passed through the lens structure 300 is outwardly emitted. Therefore, the lens structure 300 is exposed outward through the first opening portion (G). It is recommended that the case 100 should be made of a thermal conductive material in order to radiate heat from the light emitting module 400. For example, the case 100 may be made of a metallic material, specifically, made of at least one of Al, Ni, Cu, Au, Sn, Mg and stainless steel. Also, the outer surface of the case 100 may include a plurality of heat radiating fins 110 radiating the heat from the light emitting module 400. Since the heat radiating fins 110 increase the surface area of the case 100, the case 100 is able to more effectively radiate the heat.

The packing structure 200 is disposed between the case 100 and the lens structure 300, and prevents water and impurities from penetrating through the light emitting module 400. It is recommended that the packing structure 200 should be made of an elastic material, lest water should penetrate through the packing structure 200. For example, waterproof rubber, a silicone material or the like can be used as a material of the packing structure 200. The packing structure 200 may have a circular ring shape in such a manner as to be disposed on an outer frame 330 of the lens structure 300. When the packing structure 200 is disposed on the lens structure 300, the case 100 presses the packing structure 200. Therefore, the packing structure 200 fills a space between the case 100 and the lens structure 300, thereby stopping water and impurities from penetrating through the light emitting module 400 through the first opening portion (G) of the case 100. Accordingly, the reliability of the light source module can be improved.

The lens structure 300 is disposed on the light emitting module 400 and optically controls light emitted from the light emitting module 400. The lens structure 300 includes a lens 310 and an outer frame 330. The lens structure 300 may be injection-molded by use of a light transmitting material. The light transmitting material can be implemented by a plastic material such as glass, poly methyl methacrylate (PMMA), polycarbonate (PC) and the like.

A plurality of lenses 310 are disposed on the top surface of the lens structure 300. The lens 310 may have a dome shape. The lens 310 controls light incident from the light emitting module 400. Here, the control of the light means a diffusion or collection of the light incident from the light emitting module 400. When the light emitting device 430 of the light emitting module 400 is a light emitting diode, the lens 310 is able to diffuse the light from the light emitting device 430. Besides, the lens 310 is also able to collect the light from the light emitting module 400 instead of diffusing. The lens 310 may one-to-one correspond to the light emitting device 430 of the light emitting module 400. The lens 310 may include a fluorescent material (not shown).

The fluorescent material may include at least one of a yellow fluorescent material, a green fluorescent material or a red fluorescent material. Particularly, when the light emitting device 430 of the light emitting module 400 is a blue light emitting diode, the lens 310 may include at least one of the yellow, green and red fluorescent materials. Thus, thanks to the fluorescent material included in the lens 310, a color rendering index (CRI) of light emitted from the light emitting device 430 can be improved.

The packing structure 200 is disposed on the outer frame 330 of the lens structure 300. For this purpose, the outer frame 330 may have a flat shape allowing the packing structure 200 to be entirely seated on the outer frame 330. However, the outer frame 330 may be inward or outward inclined without being limited to this. When the packing structure 200 includes a predetermined recess, the outer frame 330 may include a projection (not shown) which is fitted into and coupled to the predetermined recess. As such, the outer frame 330 has various types of embodiments allowing the packing structure 200 to be easily mounted thereon.

It is desirable that the outer frame 330, together with the case 100, should be configured to press the packing structure 200. In this case, it is possible to protect the light emitting module 400 from water or impurities by preventing the water or impurities from being introduced between the outer frame 330 and the packing structure 200.

The outer frame 330 may cause the lens 310 and the light emitting device 430 of the light emitting module 400 to be spaced from each other at a regular interval. The outer frame 330 may form a space between the lens 310 and the light emitting device 430. This is because when the light emitting device 430 of the light emitting module 400 is a light emitting diode, a regular interval is required between the light emitting module 400 and the lens 310 in order to obtain a desired light distribution. For example, light emitted from the light emitting diode 430 may have a light distribution angle of approximately 120°.

The light emitting module 400 is disposed on the clad metal layer 600 and under the lens structure 300. The light emitting module 400 includes, as shown in FIG. 4, a substrate 410 and a plurality of the light emitting devices 430 disposed on the substrate 410. The substrate 410 may have a disc shape. However, the shape of the substrate 410 is not limited to this.

The substrate 410 may be disposed by printing a circuit on an insulator and may include an aluminum substrate, a ceramic substrate, a metal core PCB or a common PCB. The plurality of the light emitting devices 430 are disposed on one side of the substrate 410. The one side of the substrate 410 may have a color capable of efficiently reflecting light, for example, white color.

Here, the plurality of the light emitting devices 430 may be disposed on the substrate 410 in the form of an array. The shape and the number of the plurality of the light emitting devices 430 may be variously changed according to needs. The light emitting device 430 may be a light emitting diode (LED). At least one of a red LED, a blue LED, a green LED or a white LED may be selectively used as the light emitting device 430. The light emitting device 430 may be variously transdisposed.

The substrate 410 may further include a DC converter, a protective device (circuit) or the like. The DC converter converts AC to DC and supplies the DC. The protective device protects the lighting device from ESD, a Surge phenomenon or the like.

A heat radiating plate (not shown) may be attached to the bottom surface of the substrate 410. The heat radiating plate (not shown) may efficiently transfer the heat generated from the light emitting module 400 to the clad metal layer 600. The heat radiating plate (not shown) may be disposed of a material having thermal conductivity. For example, the heat radiating plate may be a thermal conduction silicon pad or a thermal conductive tape.

The insulating structure 500 surrounds the outer circumferential surface of the light emitting module 400. To this end, the insulating structure 500 may have a ring shape in accordance with the shape of the light emitting module 400. Although the embodiment shows that the insulating structure 500 has a ring shape, there is no limit to the shape of the insulating structure 500. The insulating structure 500 is made of an insulation material, for example, a rubber material or a silicone material. Therefore, the insulating structure 500 functions to electrically protect the light emitting module 400. That is, the insulating structure 500 electrically insulates the light emitting module 400, the clad metal layer 600 and the case 100 from each other. Therefore, a withstand voltage can be increased and the reliability can be improved. The insulating structure 500 is also able to prevent water or impurities from being introduced into the light emitting module 400.

The clad metal layer 600 is disposed by combining a plurality of heterogeneous metal layers. The clad metal layer 600 is disposed under the light emitting module 400 and may be coupled to the case 100. Therefore, the clad metal layer 600 is able to radiate heat from the light emitting module 400 by itself or transfer the heat to the case 100. The clad metal layer 600 may be configured to come in direct or indirect contact with the bottom surface of the light emitting module 400. When the clad metal layer 600 comes in indirect contact with the bottom surface of the substrate 410 of the light emitting module 400, it means that the heat radiating plate (not shown) is disposed on the bottom surface of the substrate 410.

Figure 5:
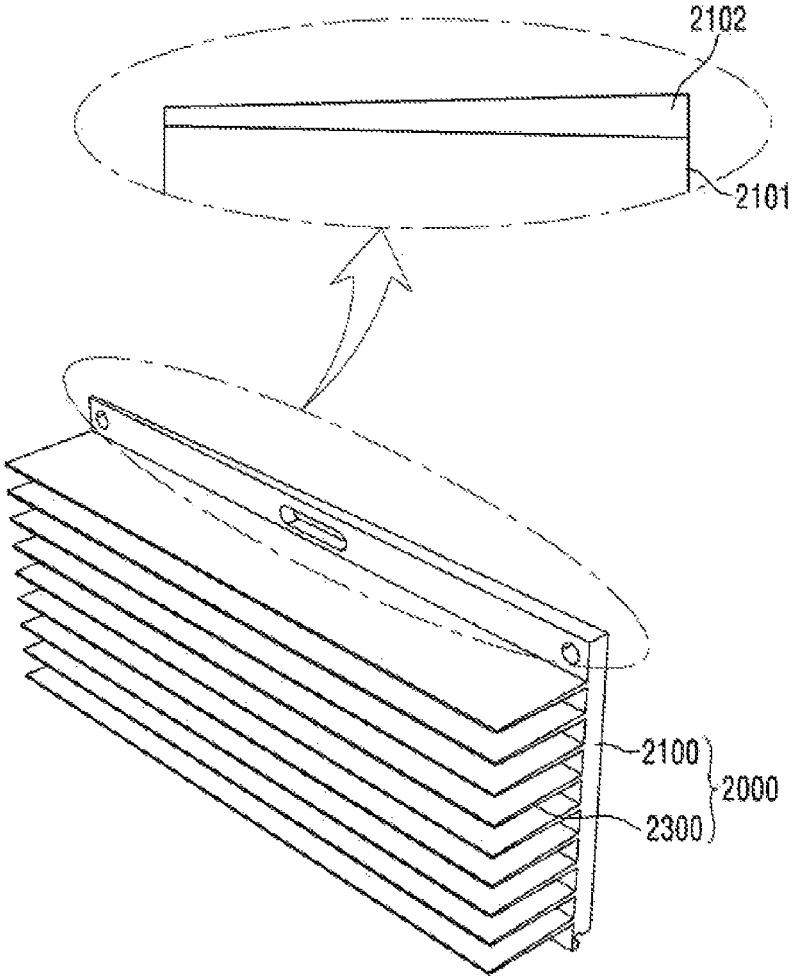
FIG. 5 is a perspective view of a heat radiating plate according to the embodiment.
Figure 6:
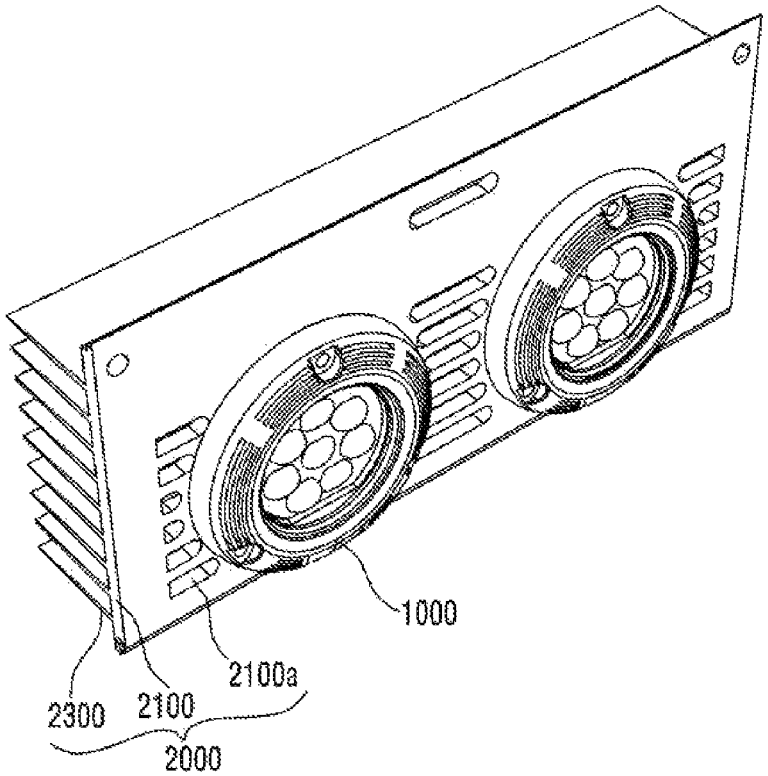
FIG. 6 is a perspective view of the light source module according to the embodiment.

FIG. 5 is a perspective view of a heat radiating plate according to the embodiment. FIG. 6 is a perspective view of the light source module according to the embodiment.

The heat radiating plate 2000 includes, as shown in FIGS. 5 and 6, a base 2100 and a plurality of the heat radiating fins 2300 extending from one side of the base 2100. The base 2100 may include one or more through-holes **2100*a* disposed in an area thereof between the heat radiating fins 2300. For example, the through-hole 2100*a* may be disposed in an area around the light source module 1000 disposed on the other side of the base 2100**.

The heat radiating plate 2000 is able to radiate heat generated from the light source module 1000 by itself. Also, at least one through-hole **2100*a* disposed in the base 2100 of the heat radiating plate 2000 is able to more improve the heat radiating characteristic by radiating the heat generated from the light source module 1000** by convection with outside air.

The through-hole **2100*a* allows fluid like rainwater to pass through the heat radiating plate 2000** thereby improving waterproof characteristics.

The base 2100 of the heat radiating plate 2000, as shown in FIG. 5, may include a top surface 2101 and a bottom surface 2102. The bottom surface 2102 may be inclined at a predetermined angle with respect to the flat top surface 2101. That is, one side of the base 2100 is inclined at a predetermined angle. Here, the inclined direction of the one side of the base 2100 corresponds to the longitudinal direction of the heat radiating fin 2300, which allows fluid in case of rain to flow along the right and left edges of the heat radiating plate. The fluid flowing along the edges is discharged to the outside through a second opening portion (see "G1" of FIG. 7) disposed in the side frame 3000 disposed on the right and left of the heat radiating plate 2000.

The heat radiating plate 2000 may be disposed of a thermal conductive material in order to radiate heat from the light source module 1000. For example, the case 100 may be disposed of a metallic material. For instance, the case 100 may be disposed of at least any one selected from the group consisting of Cu, Ag, Au, Ni, Al, Cr, Ru, Re, Pb, Cr, Sn, In, Zn, Pt, Mo, Ti, Ta, W and Mg, or may be disposed of an alloy including the metallic materials.

Meanwhile, though not shown in the drawing, a heat radiation sheet or a thermal pad may be interposed between the light source module 1000 and the heat radiating plate 2000.

Figure 7:
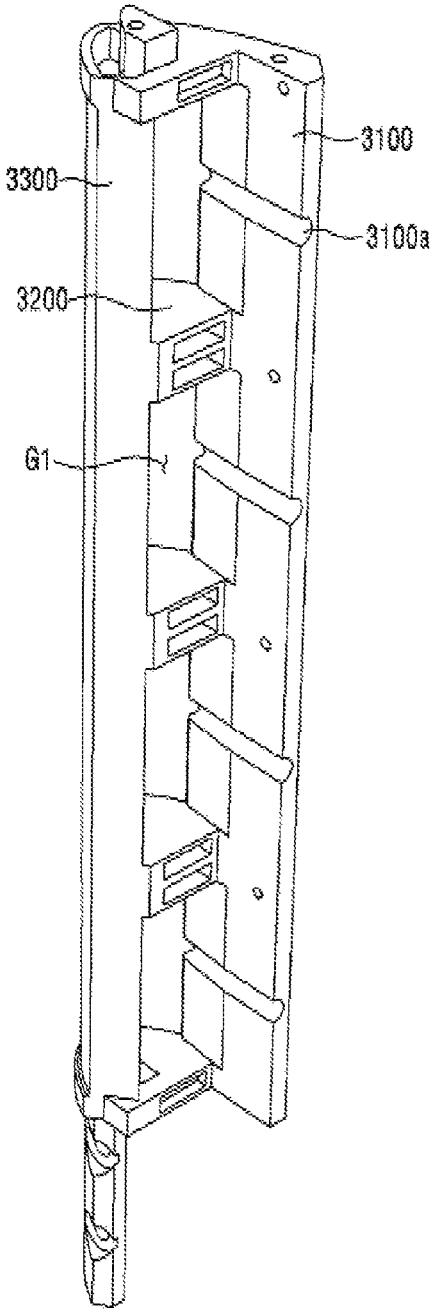
FIG. 7 is a perspective view of a side frame according to the embodiment.
Figure 8:
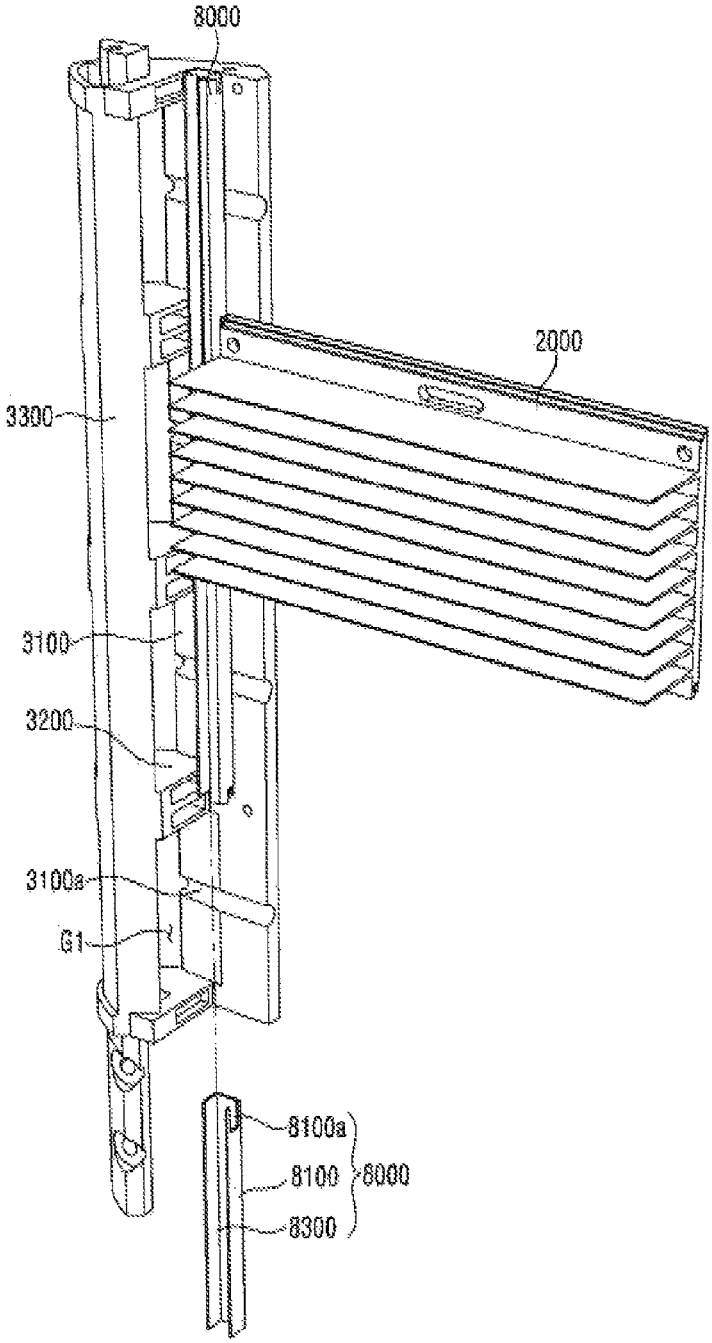
FIG. 8 is a perspective view showing a duct according to the embodiment and the surroundings of the duct.

FIG. 7 is a perspective view of a side frame according to the embodiment. FIG. 8 is a perspective view showing a duct according to the embodiment and the surroundings of the duct.

The side frame 3000 includes, as shown in FIG. 7, a lower member 3100, an upper member 3300 spaced apart from the lower member 3100, and at least one connecting member 3200 which connects the lower member 3100 with the upper member 3300. The side frame 3000 includes the second opening portion (G1) partitioned by the upper member 3300, the lower member 3100 and the connecting member 3200. The second opening portion (G1) has the same direction as that of the space between the plurality of the heat radiating fins 2300 of the heat radiating plate 2000. Accordingly, the second opening portion (G1) functions as a path for outwardly discharging the fluid flowing out from the heat radiating plate 2000.

The side frame 3000 is disposed at the side of the heat radiating plate 2000. The end of the heat radiating plate 2000 is disposed on the lower member 3100 of the side frame 3000, so that the side frame 3000 is coupled to the heat radiating plate 2000.

Also, one side of the side frame 3000 is screw fastened (not shown) to the support frame 5000. The other side of the side frame 3000 is screw fastened to the cap 7000. As a result, the shape of the lighting device is implemented.

The size of the side frame 3000 is maintained as large as the size (height) of the heat radiating plate 2000 disposed within the side frame 3000, so that the entire lighting device can be thinner. A height from the top to the bottom of the side frame 3000 may be greater than a height from the top to the bottom of the heat radiating plate 2000 so as to stably surround the entire heat radiating plate 2000.

The side frame 3000 may be disposed of a metallic material with rigidity to support the heat radiating plate 2000. However, the side frame 3000 may be disposed of a plastic material such as glass, poly methyl metacrylate (PMMA), polycarbonate (PC) or the like in order not only to allow the side frame 3000 to be more easily injection-molded but also to reduce the weight of the lighting device like a street lamp when the side frame 3000 is used in the lighting device.

A portion of the top surface of the lower member 3100 of the side frame 3000 may be inclined with respect to the bottom surface of the lower member 3100. Here, the inclined direction may be perpendicular to the longitudinal direction of the lower member 3100. Accordingly, the fluid flowing out from the heat radiating plate 2000 can be more easily discharged outwardly.

The top surface of the lower member 3100 may have a plurality of grooves 3100*a* in the inclined direction of the lower member 3100. In other words, the groove 3100*a* may be disposed in the top surface of the lower member 3100 in a direction perpendicular to the longitudinal direction of the lower member 3100. Here, one groove 3100*a* or the plurality of the grooves 3100*a* may be disposed in each second opening portion (G1) of the side frame 3000.

The duct 8000 has, as shown in FIG. 8, an open upper portion, a base 8100 and an extension part 8300 which extends upwardly from both ends of the base 8100.

The duct 8000 may be provided in a single form adjacent to the heat radiating plate 2000 and disposed on the lower member 3100 of the side frame 3000. In addition, a plurality of the ducts 8000 may be provided and combined with or separated from each other in such a manner that the length of the duct 8000 may be changed depending on the increase or decrease of the light source module 1000.

One side of the extension part 8300 of the duct 8000 includes a hole 8100*a* functioning as a path for a power cable (not shown) for supplying electric power to the light source module 1000. The duct 8000 is adjacent to the heat radiating plate 2000 and is disposed on the lower member 3100 of the side frame 3000 in the longitudinal direction of the side frame 3000. That is to say, the heat radiating plate 2000, the duct 8000 and the side frame 3000 are disposed in the order specified, and the connecting member 3200 of the side frame 3000 supports closely the lateral side of the duct 8000.

Here, a constant gap may be disposed between the duct 8000 and the heat radiating plate 2000. This intends that the fluid flowing on the heat radiating plate 2000 passes through the second opening portion (G1) or the groove 3100*a* of the side frame 3000 along the gap between the duct 8000 and the heat radiating plate 2000, and then is discharged to the outside.

When the duct 8000 is disposed to the side frame 3000, it is recommended that the height of the duct 8000 should be equal to or less than the height of the base 2100 of the heat radiating plate 2000.

Figure 9:
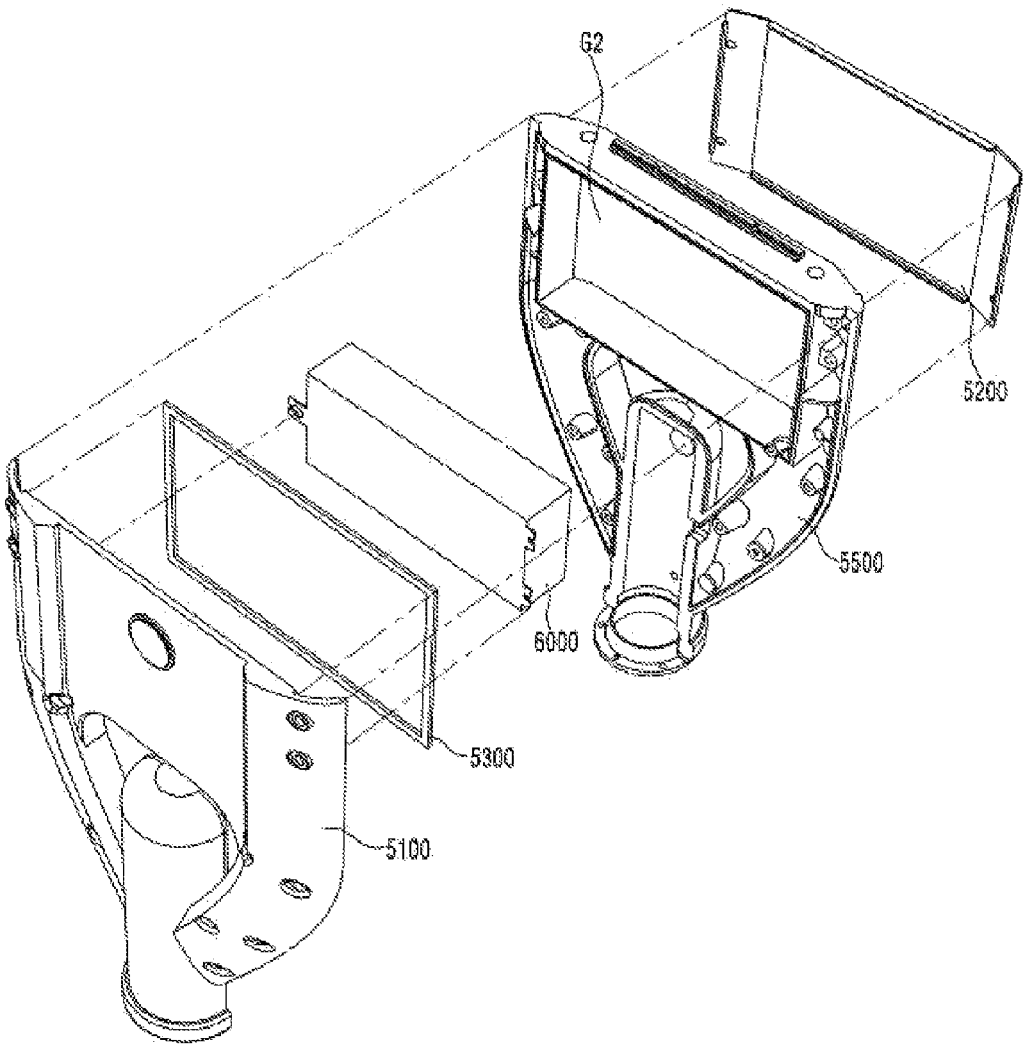
FIG. 9 is an exploded perspective view of a support frame according to the embodiment.

FIG. 9 is an exploded perspective view of a support frame according to the embodiment.

The support frame 5000 includes, as shown in FIG. 9, an upper support frame 5100 and a lower support frame 5500.

The lower support frame 5500 includes an inner space in which the power controller 6000 is disposed and includes a third opening portion (G2) corresponding to the inner space. The third opening portion (G2) allows the power controller 6000 to be easily maintained and repaired. After the power controller 6000 is disposed, the third opening portion (G2) is covered with and protected by a flange 5200. The flange 5200 is fastened and coupled to a screw (not shown) of the lower support frame 5500.

Additionally, a packing 5300 is disposed in the inner space such that the lower support frame 5500 is stably and closely coupled to the upper support frame 5100.

The support frame 5000 may have any shape allowing the power controller 6000 to be disposed thereinside. Here, it is desirable that the power controller 6000 should be disposed close to the light source module 1000 disposed in the heat radiating plate 2000. This is because it is possible to prevent voltage drop caused by a distance between the power controller 6000 and the light source module 1000.

Although embodiments of the present invention were described above, these are just examples and do not limit the present invention. Further, the present invention may be changed and modified in various ways, without departing from the essential features of the present invention, by those skilled in the art. For example, the components described in detail in the embodiments of the present invention may be modified. Further, differences due to the modification and application should be construed as being included in the scope and spirit of the present invention, which is described in the accompanying claims.

What is claimed is:

1. A Light Emitting Diode (LED) lighting device, comprising:

a plurality of heat radiating plates having a right side, a left side, a top side, a bottom side, a top surface and a bottom surface;

at least one light source module disposed on the top surface of the heat radiating plate;

a cover disposed on the bottom surface of the heat radiating plate;

two side frames, each of which is disposed on the right side and the left side of the heat radiating plate, respectively;

a cap disposed on the top side of the heat radiating plate, and coupled to one end of the side frame; and a support frame disposed on the bottom side of the heat radiating plate, and coupled to the other end of the side frame, wherein the side frame comprises:

a lower member;

an upper member spaced apart from the lower member;

at least one connecting member which connects the lower member with the upper member; and an opening portion partitioned by the upper member, the lower member and the connecting member.

2. The LED lighting device of claim 1, wherein the plurality of heat radiating plates are arranged in contact with each other in a longitudinal direction of the side frame.

3. The LED lighting device of claim 1, wherein the light source module comprises at least one light emitting device.

4. The LED lighting device of claim 3, wherein the light emitting device comprises at least one of a colored LED chip, a white LED chip or an Ultraviolet (UV) chip.

5. The LED lighting device of claim 1, wherein the cover comprises a plurality of holes penetrating through the cover.

6. The LED lighting device of claim 1, wherein the heat radiating plate includes at least one selected from the group consisting of Cu, Ag, Au, Ni, Al, Cr, Ru, Re, Pb, Cr, Sn, In, Zn, Pt, Mo, Ti, Ta, W and Mg, or includes an alloy including two or more selected from the group.

7. The LED lighting device of claim 1, wherein a portion of a top surface of the lower member is perpendicular to a longitudinal direction of the lower member with respect to a bottom surface of the lower member, and a plurality of grooves is disposed in the top surface of the lower member perpendicularly to the longitudinal direction of the lower member.

8. The LED lighting device of claim 1, further comprising a heat radiation sheet or a thermal pad between the light source module and the heat radiating plate.

9. The LED lighting device of claim 1, further comprising a power controller which is disposed inside the support frame and configured to control a supply of electric power to the light source module.

10. A Light Emitting Diode (LED) lighting device, comprising:

a plurality of heat radiating plates having a right side, a left side, a top side, a bottom side, a top surface and a bottom surface;

at least one light source module disposed on the top surface of the heat radiating plate;

a cover disposed on the bottom surface of the heat radiating plate;

two side frames, each of which is disposed on the right side and the left side of the heat radiating plate respectively;

a cap disposed on the top side of the heat radiating plate, and coupled to one end of the side frame; and a support frame disposed on the bottom side of the heat radiating plate, and coupled to the other end of the side frame, wherein the light source module comprises:

a clad metal layer;

an insulating structure which is disposed on the clad metal layer;

a light emitting module which is disposed on the insulating structure and includes a plurality of light emitting device;

a lens structure which is disposed on the light emitting module;

a packing structure which is disposed on the lens structure; and a case which is disposed on the packing structure and is coupled to the clad metal layer.

11. The LED lighting device of claim 10, wherein the case comprises:

an opening portion through which light which has passed through the lens structure is emitted, and a plurality of heat radiating fins disposed on an outer surface of the case.

12. The LED lighting device of claim 10, wherein the lens structure is disposed to have a dome shape over the light emitting devices, and comprises at least one of a yellow fluorescent material, a green fluorescent material or a red fluorescent material.

13. The LED lighting device of claim 10, wherein the heat radiating plate is disposed under the light emitting module, and the heat radiating plate comprises one of a thermal conduction silicon pad or a thermal conductive tape.

14. A Light Emitting Diode (LED) lighting device, comprising:

a plurality of heat radiating plates having a right side, a left side, a top side, a bottom side, a top surface and a bottom surface;

at least one light source module disposed on the top surface of the heat radiating plate;

a cover disposed on the bottom surface of the heat radiating plate;

two side frames, each of which is disposed on the right side and the left side of the heat radiating plate respectively;

a cap disposed on the top side of the heat radiating plate, and coupled to one end of the side frame;

a support frame disposed on the bottom side of the heat radiating plate, and coupled to the other end of the side frame; and at least one duct which is adjacent to the heat radiating plate and is disposed on a lower member of the side frame in a longitudinal direction of the side frame, wherein the plurality of heat radiating plates are arranged in contact with each other in a longitudinal direction of the side frame.

15. A Light Emitting Diode (LED) lighting device, comprising:

a plurality of heat radiating plates having a right side, a left side, a top side, a bottom side, a top surface and a bottom surface;

at least one light source module disposed on the top surface of the heat radiating plate;

a cover disposed on the bottom surface of the heat radiating plate;

two side frames, each of which is disposed on the right side and the left side of the heat radiating plate respectively;

a cap disposed on the top side of the heat radiating plate, and coupled to one end of the side frame;

a support frame disposed on the bottom side of the heat radiating plate, and coupled to the other end of the side frame; and at least one duct which is adjacent to the heat radiating plate and is disposed on a lower member of the side frame in a longitudinal direction of the side frame, wherein the duct comprises:

a base, and an extension part extending upwardly from both ends of the base and including a hole at one end of the extension part.

16. A Light Emitting Diode (LED) lighting device, comprising:

a plurality of heat radiating plates having a right side, a left side, a top side and a bottom side, and comprising at least one light source module;

two side frames, each of which is disposed on the right side and the left side of the heat radiating plate respectively;

a cap disposed on the top side of the heat radiating plate, and coupled to one end of the side frame; and a support frame disposed on the bottom side of the heat radiating plate, and coupled to the other end of the side frame, wherein the heat radiating plate comprises:

a plate-shaped base;

a plurality of heat radiating fins extending upwardly from the base; and at least one hole disposed between the plurality of heat radiating fins, wherein, in the heat radiating plate, one side of the base is inclined in a longitudinal direction of the heat radiating fins.

17. The LED lighting device of claim 16, wherein, in the heat radiating plate, one or a plurality of the light source modules are disposed on a side opposite to the side on which the heat radiating fins are disposed.

18. A Light Emitting Diode (LED) lighting device comprising:

a plurality of heat radiating plates having a right side, a left side, a top side and a bottom side, and comprising at least one light source module;

two side frames, each of which is disposed on the right side and the left side of the heat radiating plate respectively;

a cap disposed on the top side of the heat radiating plate, and coupled to one end of the side frame; and a support frame disposed on the bottom side of the heat radiating plate, and coupled to the other end of the side frame, wherein the support frame comprises:

an upper support frame;

a lower support frame which is coupled to the upper support frame, includes an inner space in which a power controller is disposed and includes an opening portion corresponding to the inner space;

a flange which is fastened and coupled to an opening of the lower support frame; and a packing which is disposed between the upper support frame and the lower support frame.

* * * * *